US009585441B2

(12) United States Patent
Kaneko

(10) Patent No.: US 9,585,441 B2
(45) Date of Patent: Mar. 7, 2017

(54) BUCKLE

(71) Applicant: YKK Corporation, Tokyo (JP)

(72) Inventor: Hitoshi Kaneko, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 14/775,573

(22) PCT Filed: Mar. 12, 2013

(86) PCT No.: PCT/JP2013/056820
§ 371 (c)(1),
(2) Date: Sep. 11, 2015

(87) PCT Pub. No.: WO2014/141387
PCT Pub. Date: Sep. 18, 2014

(65) Prior Publication Data
US 2016/0021988 A1 Jan. 28, 2016

(51) Int. Cl.
*A44B 11/26* (2006.01)

(52) U.S. Cl.
CPC ..... *A44B 11/266* (2013.01)

(58) Field of Classification Search
CPC ..... A44B 11/266; A44B 11/2519; A44B 11/2534; A44B 11/2549; A44B 11/2553; A44B 11/2573; A44B 11/26; Y10T 24/45581; Y10T 24/45524; Y10T 24/45482; Y10T 24/3405; Y10T 24/3408; Y10T 24/3413; Y10T 24/4501; Y10T 24/45534; Y10T 24/45602; Y10T 24/45623;
(Continued)

(56) References Cited

U.S. PATENT DOCUMENTS 4,831,694 A * 5/1989 Kong ..... A44B 11/266 24/606
5,794,316 A 8/1998 Anscher
(Continued)

FOREIGN PATENT DOCUMENTS

EP 0815761 A2 1/1998
EP 2641498 A1 9/2013
(Continued)

OTHER PUBLICATIONS

International Preliminary Report on Patentability, PCT Application No. PCT/JP2013/083604, Sep. 24, 2015.
(Continued)

*Primary Examiner* — Robert J Sandy
*Assistant Examiner* — David Upchurch
(74) *Attorney, Agent, or Firm* — Kilpatrick Townsend & Stockton LLP

(57) ABSTRACT

A buckle including a male member; and a female member into which the male member can be inserted for engagement, when an external force in a direction opposite to the insertion direction is exerted on the male member after an engaging face of the male member and an engaged face of the female member being engaged, an engagement width between the engaging face and the engaged face becomes larger than an engagement width before the external force being exerted due to the elastic deformation of legs of the male member exposed through openings in an opposite direction to a side on which the legs faces each other.

9 Claims, 9 Drawing Sheets

(58) Field of Classification Search
CPC ..... Y10T 24/45634; Y10T 24/45775; Y10T 24/4599; Y10T 24/4736; A41D 2400/44; F41H 1/02
See application file for complete search history.

(56) References Cited

U.S. PATENT DOCUMENTS

| | | | | |
|---|---|---|---|---|
| 7,559,123 | B1 * | 7/2009 | Yang | A44B 11/266 24/316 |
| 7,685,685 | B2 * | 3/2010 | Giampavolo | A44B 11/2519 24/614 |
| 8,196,273 | B2 * | 6/2012 | Anscher | A44B 11/266 24/265 BC |
| 9,113,680 | B2 | 8/2015 | Takazakura | |
| 2003/0074772 | A1 * | 4/2003 | Chen | A44B 11/266 24/614 |
| 2005/0132545 | A1 * | 6/2005 | Anscher | A44B 11/2549 24/615 |
| 2006/0053600 | A1 * | 3/2006 | Liu | A44B 11/266 24/615 |
| 2007/0204441 | A1 * | 9/2007 | Saitsu | A44B 11/2534 24/614 |
| 2011/0173783 | A1 * | 7/2011 | Kaneko | A44B 11/266 24/615 |
| 2013/0232743 | A1 * | 9/2013 | Takazakura | A44B 11/266 24/625 |

FOREIGN PATENT DOCUMENTS

| | | | |
|---|---|---|---|
| JP | 4-221502 | A | 8/1992 |
| JP | 2008-307342 | A | 12/2008 |
| WO | 2012/066615 | A1 | 5/2012 |

OTHER PUBLICATIONS

International Search Report, PCT Application No. PCT/JP2013/083604, May 14, 2013.

* cited by examiner

BUCKLE

This application is a national stage application of PCT/JP2013/056820, which is incorporated herein by reference.

TECHNICAL FIELD

The present invention relates to a buckle provided with a male member (plug) and a female member (socket).

BACKGROUND ART

A buckle including a plug (male member) and a socket (female member) is used as a means for coupling cord members. The plug includes a base portion having a mounting portion to mount a cord member and a pair of arm portions extending from one end of the base portion. The socket includes a body portion in a flatly tubular shape having a cavity to house the arm portions of the plug and a pair of openings to expose the tips of the arm portions of the plug from the body portion is provided on both side faces of the body portion. The plug and the socket are freely removably locked by the openings provided on both side faces of the body portion of the socket and so the buckle is called a side release buckle.

WO 2012/066615 A1 (Patent Literature 1) describes an example of a front and back engaging buckle that attaches and detaches a male member and a female member by engaging/releasing a convex engaging portion provided on the front side and the back side of a tip portion of a leg of the male member with/from an engaged portion provided in a predetermined position of an inner wall face of the body portion of the female member.

However, a front and back engaging buckle as described in Patent Literature 1 may have a complex shape, which makes it difficult to mold the buckle. Thus, a side engaging buckle that engages and releases the plug and the socket using an inclined plane or a protrusion protruded in an outer direction from both side faces of the leg of the plug has been widely used as a buckle having a simpler configuration.

U.S. Pat. No. 5,794,316 A (Patent Literature 2) has been known as an example of the side engaging buckle. In Patent Literature 2, a V-shaped stop member is provided inside the female member and also a V-shaped hook face is provided in the leg of the male member. The male member and the female member are freely removably coupled by inserting the leg of the male member into the female member to engage/release the V-shaped stop member with/from the V-shaped hook face on both side faces of the female member.

CITATION LIST

Patent Literature

Patent Literature 1: WO 2012/066615 A1
Patent Literature 2: U.S. Pat. No. 5,794,316 A

SUMMARY OF INVENTION

Problem to be Solved by the Present Invention

As described above, the side engaging buckle adopts a configuration in which the female member and the female member are engaged or released basically on the hook face protruding from the side face of the leg of the male member. Thus, if an unintended tensile force is applied in a direction in which the male member and the female member are separated from each other after engagement, the male member and the female member may automatically be released or the leg of the male member may be damaged after the engaged state being disengaged.

As a method of increasing tensile strength of the male member and the female member, a method of increasing the strength of the leg of the male member by increasing the cross section of the leg (thickness of the leg) of the male member or providing a rib has been known. Alternatively, as described in Patent Literature 2, a technique of securing a greater area of the hook face formed on the leg of the male member to be an engaging face with the female member can be considered to achieve more reliable engagement of the male member and the female member.

However, if the cross section of the leg is increased or a rib is provided, the leg becomes less likely to sag, increasing a release load when the male member and the female member are separated. On the other hand, if, like in Patent Literature 2, the engagement area of the hook face of the male member is increased, a migration area between the engaging face and the hook face needed for release also increases, leading to an increased load (release load) for release.

In view of the above problems, the present invention provides a buckle capable of improving tensile strength in a simple configuration without excessively increasing the load for release.

Means for Solving the Problem

To solve the above problems, according to an aspect of the present invention, a buckle provided with a male member and a female member into which the male member can be inserted for engagement, wherein the male member includes a base portion on which a cord member can be mounted, a pair of legs extending from one end of the base portion, and a pair of engaging faces each protruding from a side face of the leg on an opposite side of a side on which the pair of legs faces each other and defined on a face intersecting an insertion direction (X) of the male member, the female member includes a body portion having an insertion port into which the leg can be inserted on one end, a mounting portion on which a cord member can be mounted on the other end, and a cavity communicatively connected to the insertion port to house the legs internally, a pair of openings passing through a wall portion of the body portion so as to communicatively connect to the cavity, and an engaged face defined on an opening sidewall face exposed from the opening toward the mounting portion and capable of engaging with the engaging face by a restoring force for elastic deformation of the leg when the leg is inserted up to a predetermined position in the cavity, and when an external force in a direction opposite to the insertion direction (X) is exerted on the male member after the engaging face of the male member and the engaged face of the female member being engaged, an engagement width (W2) between the engaging face and the engaged face becomes larger than an engagement width (W1) before the external force being exerted due to the elastic deformation of the leg exposed through the opening in an opposite direction to the side on which the pair of legs face each other is provided.

In another embodiment of the buckle according to the present invention, the engaging face is an inclined plane inclined with respect to the insertion direction of the male member.

In still another embodiment of the buckle according to the present invention, a space permission portion to permit the elastic deformation of the leg exposed through the opening in the opposite direction in a state in which the engaging face and the engaged face are engaged is provided in the cavity between a side face of the leg and inner wall faces of the female member adjacent to the opening sidewall face.

In still another embodiment of the buckle according to the present invention, the leg includes a base end portion extending in the insertion direction (X) from the base portion and a swelling portion further extending in the insertion direction (X) from the base end portion and also swelling in a leg width direction (Y) intersecting the insertion direction (X) and the base end portions are inclined with respect to the insertion direction (X) so as to gradually come closer to each other from a base end side in contact with the base portion toward an end side continuing to the swelling portion.

In still another embodiment of the buckle according to the present invention, the leg includes a base end portion extending in the insertion direction (X) from the base portion and a swelling portion further extending in the insertion direction (X) from the base end portion and also swelling in a leg width direction (Y) intersecting the insertion direction (X), the engaging face is provided in the swelling portion, and the engaging face and the engaged face are on a straight line (A) parallel to the insertion direction (X) and passing through a connection portion of the base end portion to the base portion.

In still another embodiment of the buckle according to the present invention, the straight line (A) passes through an outer portion of the base end portion positioned farthest from the side on which the base end portions face each other on the side face on the opposite side of the side facing each other.

In still another embodiment of the buckle according to the present invention, the male member includes a guide portion extending in the insertion direction (X) from the base portion between the legs and the female member includes on the inner wall face a concave guide groove capable of inhibiting movement of the male member in a direction (Z) intersecting the insertion direction (X) when the legs of the male member are housed in the cavity.

In still another embodiment of the buckle according to the present invention, the male member further includes movement regulators provided by each protruding from side faces of the side on which the legs face each other and deformation regulators connected to the base portion by being spaced from the movement regulator and with which the movement regulator comes into contact when the leg is elastically deformed in the opposite direction (Z) to regulate further deformation of the leg in the opposite direction (Z).

Advantageous Effects of Invention

According to the present invention, a buckle capable of improving tensile strength in a simple configuration without excessively increasing the load for release can be provided.

DESCRIPTION OF EMBODIMENTS

Figure 1:
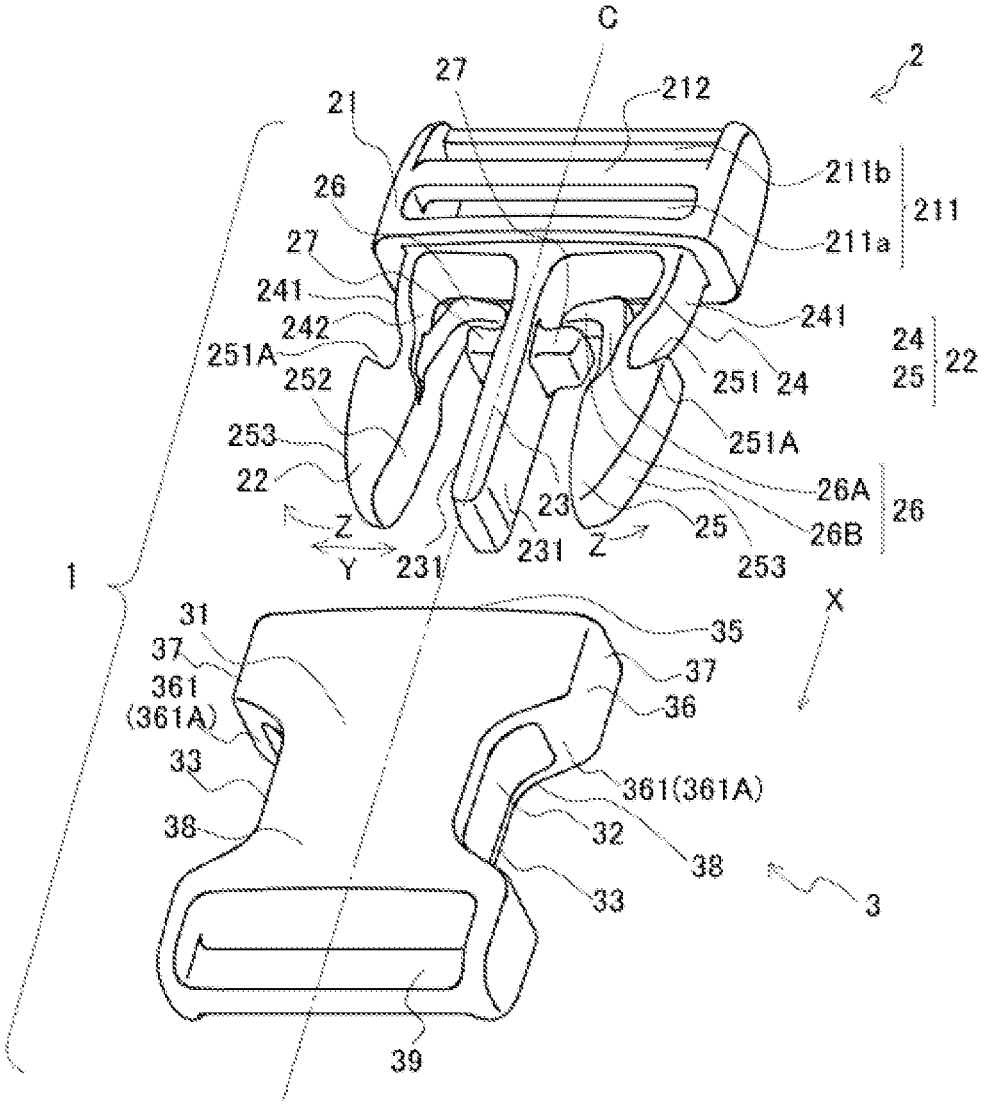
FIG. 1 is a perspective view showing a buckle according to an embodiment of the present invention.

Hereinafter, an embodiment of the present invention will be described with reference to the drawings. In the description of the following drawings, the same reference numerals or similar ones are attached to the same portions or similar ones. The embodiment shown below illustrates a technical idea of the present invention and the technical idea of the present invention does not limit the structure, arrangement, material and the like of components to those described below.

As shown in FIG. 1, a buckle 1 according to an embodiment of the present invention includes a male member 2 and a female member 3 with which the male member 2 is engaged by insertion. The male member 2 is integrally molded from metal or resin. The male member 2 includes a base portion 21 on which a cord member can be mounted, a pair of legs 22 extending from one end of the base portion 21, engaging faces 251A each protruding from a side face 241 of the leg 22 on the opposite side of the side on which the pair of legs 22 faces each other and defined on a face (intersection face 251) intersecting an insertion direction (X direction in FIG. 1) of the male member 2, and a guide portion 23 protruding from the base portion 21 between the pair of legs 22 in the insertion direction (X) toward the female member 3.

Figure 8:
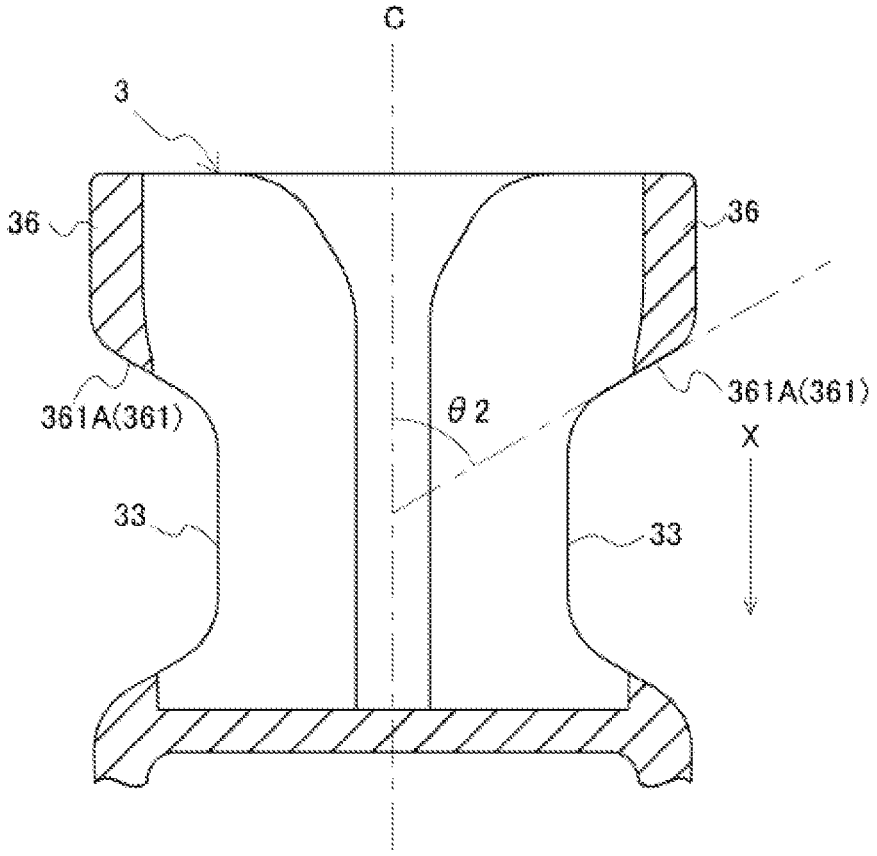
FIG. 8 is a sectional view illustrating the angle of inclination of an engaged face held by the female member in the buckle according to an embodiment of the present invention.

In the present invention and inventions below, as shown in FIG. 1, a line passing through center of the male member 2 and parallel to the insertion direction (X) is defined as a center axis (C) and when each component is viewed from the center axis (C), the direction relatively closer to the center axis (C) is called an "inner side" or a "side on which the legs 22 face each other" and the direction relatively farther from the center axis (C) is called an "outer side" or an "opposite side of the side on which the legs 22 face each other". As shown in FIG. 8, the center axis (C) is also a center axis passing through the center of the female member 3.

A string mounting hole 211 into which an end of a cord member is inserted is formed in the base portion 21 of the male member 2. A coupling rod 212 to couple the cord member to the male member 2 is provided in the center of the string mounting hole 211. The string mounting hole 211 is divided into two string mounting holes 211*a*, 211*b* by the coupling rod 212. The cord member is made mountable on the male member 2 and also the length thereof can be adjusted by being passed through the string mounting holes 211*a*, 211*b* and wound around the coupling rod 212.

The leg 22 of the male member 2 includes a base end portion 24 in a columnar shape extending in the insertion direction (X) from the base portion 21 and a swelling portion 25 further extending in the insertion direction (X) from the base end portion 24 like protruding and also swelling in a leg width direction (Y direction in FIG. 1) intersecting the insertion direction (X). The swelling portion 25 is formed in a shape in which the dimension in the leg width direction (Y) gradually becomes narrower toward the end side of the leg 22. The swelling portion 25 is also provided with the intersection faces 251 intersecting the insertion direction (X) of the male member 2 like each protruding in an outer direction from the side face 241 on the outer side of the base end portion 24 and the engaging face 251A that can be engaged with or released from the female member 3 is defined on the intersection face 251.

Figure 7:
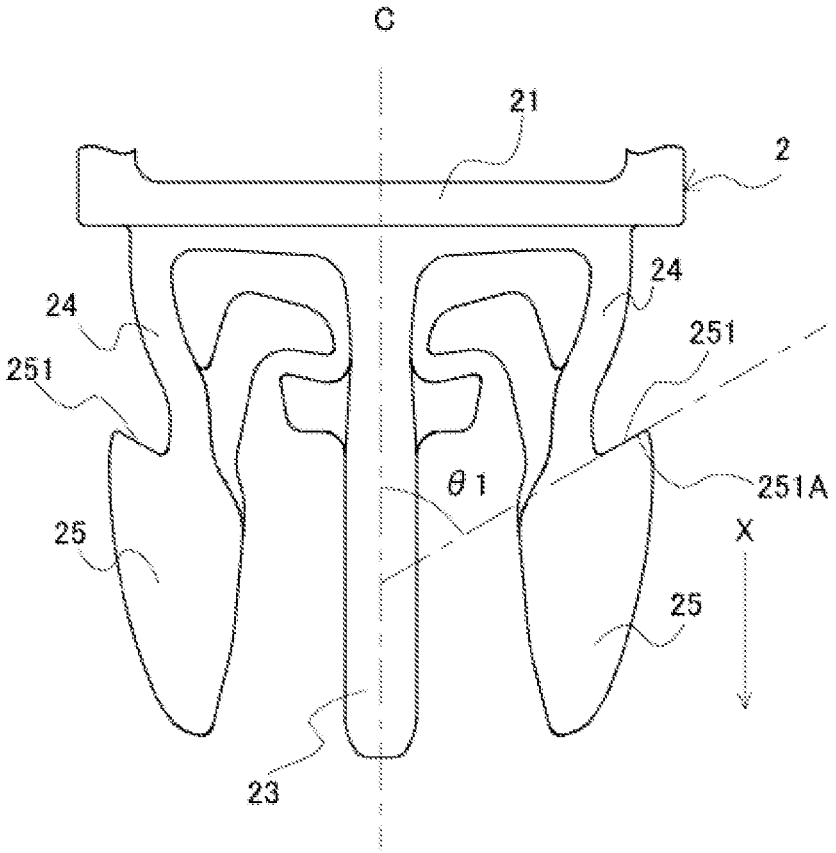
FIG. 7 is a plan view illustrating an angle of inclination of an engaging face held by the male member in the buckle according to an embodiment of the present invention.

The intersection face 251 is preferably an inclined plane inclined with respect to the insertion direction (X). More specifically, as shown in FIG. 7, the intersection face 251 is preferably an inclined plane inclined at an angle of inclination θ1 with respect to the center axis (C) parallel to the insertion direction (X). The "angle of inclination θ1" means an angle formed by the intersection face 251 viewed from the center axis (C) parallel to the insertion direction (X). More specifically, the angle of inclination 01 of the intersection face 251 of the leg 22 on the right side in FIG. 7 means an angle measured clockwise from the center axis (C). The angle of inclination θ1 of the intersection face 251 of the leg 22 on the left side in FIG. 7 means an angle measured counterclockwise from the center axis (C).

The magnitude of the angle of inclination θ1 is preferably 90° or less. If, for example, the angle of inclination θ1 of the intersection face 251 is too large (for example, when the intersection face 251 is inclined more downward from the intersection face 251 toward the outer side in FIG. 7), the male member 2 more likely to come off the female member 3 due to an unintended external force. On the other hand, if the angle of inclination θ1 of the intersection face 251 is too small, it is necessary to insert the male member 2 into a deeper position of the female member 3 to engage the male member 2 with the female member 3. Thus, a gap G (see FIG. 4) arising between the base portion 21 of the male member 2 and the female member 3 after the engagement of the male member 2 and the female member 3 needs to be made larger. If the gap G is made too large, the buckle 1 after the insertion may be more likely to rattle. Possibly, damage may occur in a contact portion with the base portion 21 of the base end portion 24. Therefore, the angle of inclination θ1 is preferably set to 90° or less and particularly preferably, θ1 is set to 55° to 65°.

The male member 2 further includes, as shown in FIG. 1, movement regulators 26 provided by each protruding from the side faces of the side on which the legs 22 face each other (that is, an inner face 242 of the base end portion 24 and an inner face 252 of the swelling portion 25) so as to protrude toward the side (inner side) on which the legs 22 face each other. The guide portion 23 has a columnar shape protruding from the base portion 21 toward the insertion direction (X) so as to extend along the center axis (C) and the guide portion 23 is provided with a pair of deformation regulators 27 each protruding to the outer side from an outer face 231 of the guide portion 23. The deformation regulator 27 is provided in an intermediate position in the longitudinal direction of the guide portion 23 and arranged by being spaced from the movement regulator 26.

The movement regulator 26 includes a branch portion 26A protruding to the inner side from the inner face 252 of the swelling portion 25 and the inner face 242 of the base end portion 24 and extending in the opposite direction of the insertion direction (X) and an end portion 26B formed by being bent like a hook from the branch portion 26A toward the center of the male member 2 where the guide portion 23 is arranged. The end portion 26B is arranged opposite to the deformation regulator 27 in the insertion direction (X).

Figure 3:
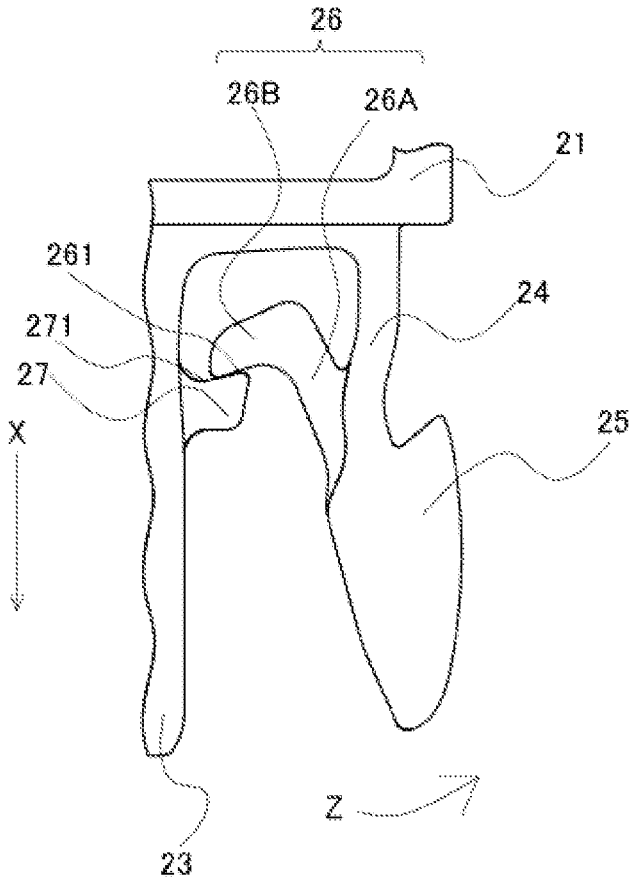
FIG. 3 is a plan view showing a contact state of a movement regulator and a deformation regulator of the buckle according to an embodiment of the present invention.

As shown in FIG. 3, by including the deformation regulator 27 and the movement regulator 26, a wall portion 261 opposite to the deformation regulator 27 of the end portion 26B of the movement regulator 26 integrally molded with the leg 22 and a wall portion 271 on the side opposite to the end portion 26B of the deformation regulator 27 come into contact when the swelling portion 25 is moved in an outer direction (Z) by elastic deformation of the base end portion 24 of the leg 22 in the outer direction. As a result, the movement regulator 26 comes into contact with the deformation regulator 27 and the swelling portion 25 contiguous with the movement regulator 26 can no longer be elastically deformed further in the outer direction (Z). Thus, even if an external force is exerted in a direction opposite to the side on which the legs 22 face each other, the movement regulator 26 and the deformation regulator 27 come into contact to be mutually supported, inhibiting breakage and plastic deformation of the leg 22.

The movement regulator 26 and the base portion 21 are arranged with a sufficient interval therebetween so that the movement regulator 26 does not come into contact with the base portion 21 when the male member 2 is housed in a cavity 32 after the base end portion 24 being elastically deformed in the inner direction to move the swelling portion 25 in the inner direction. Accordingly, when the male member 2 and the female member 3 are engaged by insertion, the movement regulator 26 is kept out of the way.

The female member 3 is integrally molded from metal or resin. The female member 3 includes, as shown in FIG. 1, a body portion 31 in a flatly tubular shape having an insertion port 35 into which the leg 22 of the male member 2 can be inserted on one end and a mounting portion 39 on which a cord member can be mounted on the other end. A cavity 32 communicatively connected to the insertion port 35 to house the legs 22 of the male member 2 is provided inside the body portion 31. A pair of openings 33 is provided like passing through a wall portion 36 of the body portion 31 to communicatively connect to the cavity 32.

An engaged face 361A to lock the engaging face 251A of the leg 22 of the male member 2 is defined on an opening sidewall face 361 of the wall portion 36 exposed from the opening 33 of the female member 3 toward the mounting portion 39. The engaged face 361A is a face releasably engaged with the engaging face 251A of the male member 2 by a restoring force for elastic deformation of the base end portion 24 of the leg 22 when the leg 22 is inserted up to a predetermined position.

As shown in FIG. 8, the engaged face 361A is preferably an inclined plane inclined at the angle of inclination θ2 with the insertion direction (X) (or the center axis (C)). The "angle of inclination θ2" means an angle formed by the engaged face 361A viewed from the center axis (C) parallel to the insertion direction (X). More specifically, the angle of inclination θ2 of the engaged face 361A on the right side in FIG. 8 means an angle measured clockwise from the center axis (C). The angle of inclination θ2 of the engaged face 361A on the left side in FIG. 8 means an angle measured counterclockwise from the center axis (C).

The magnitude of the angle of inclination θ2 of the engaged face 361A is preferably adjusted to be equivalent to the angle of inclination θ1 of the engaging face 251A or smaller than the angle of inclination θ1 of the engaging face 251A. More specifically, the angle of inclination θ2 is preferably 55° to 65°.

As shown in FIG. 1, the wall portion 36 of the body portion 31 can be configured by four wall portions, a pair of first sidewall portions 37 (a left wall portion on the left side and a right wall portion on the right side) as opposed faces provided with the opening 33 and a pair of second sidewall portions 38 (an upper wall portion and a lower wall portion) integrally connected to the first sidewall portions 37 and facing each other. The second sidewall portions 38 include the upper wall portion and the lower wall portion opposed in an up and down direction intersecting the insertion direction (X) and an inner wall face of one or both of the second sidewall portions 38 facing each other is provided with a guide groove 34 to guide the guide portion 23 of the male member 2 into the cavity 32 when the legs 22 of the male member 2 are housed in the cavity 32. In the example shown in FIG. 2, an example in which the guide groove 34 is arranged on an inner wall face 381 of the lower wall portion constituting the second sidewall portions 38 is shown, but a similar guide groove may also be provided on the inner wall face (not shown) of the upper wall portion opposed to the lower wall portion or a guide groove may not be provided on the inner wall face of the upper wall portion.

In the present embodiment, the "up and down direction" refers to a front and back direction of the buckle 1 shown in FIGS. 1 to 9. That is, the "up and down direction" means a depth direction perpendicular to the insertion direction (X) and also perpendicular to the paper surface of FIG. 2. In other words, of the two second sidewall portions 38 facing each other of the female member 3 shown in FIG. 1, the second sidewall portion visible on the front side in FIG. 1 is called an "upper wall portion" and the second sidewall portion on the depth side not visible directly in FIG. 1 is called a "lower wall portion".

Figure 2:
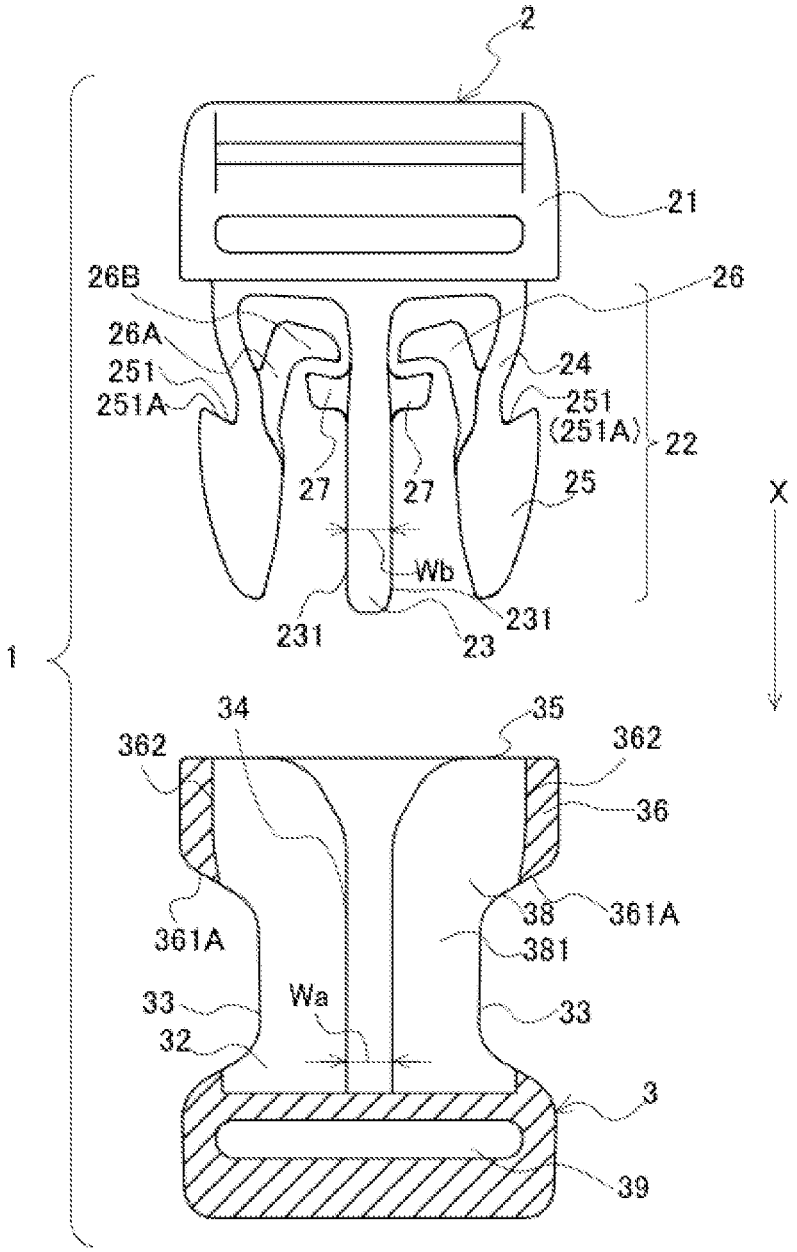
FIG. 2 is a partial sectional view showing the buckle according to an embodiment of the present invention.

The guide groove 34 shown in FIG. 2 is formed so as to continue from the insertion port 35 and the guide portion 23 in a columnar shape of the male member 2 can be slid along the guide groove 34. As shown in FIG. 2, the guide groove 34 in the vicinity of the insertion port 35 is formed so as to gradually broaden as the insertion port 35 approaches and even if the guide portion 23 is inserted in the direction (Z) intersecting the insertion direction (X) by being displaced, the male member 2 including the guide portion 23 is guided to a proper position inside the guide groove 34.

The guide groove 34 is preferably a concave groove formed such that a width Wa thereof when viewed from a direction perpendicular to the insertion direction (X) approximately matches a width Wb of the guide portion 23 in a columnar shape when viewed from a direction perpendicular to the insertion direction (X) or with a gap (clearance) of a few mm. The shape of the concave groove is molded by fitting to the outside shape of the guide portion 23 and the guide portion 23 is inserted by being fitted along the concave groove of the guide groove 34. With the widths Wa, Wb of the guide portion 23 and the guide groove 34 being formed in almost the same magnitude, the movement (rattle) of the male member 2 in a leg width direction intersecting the insertion direction (X) is inhibited after the legs 22 of the male member 2 are housed in the cavity 32.

Figure 4:
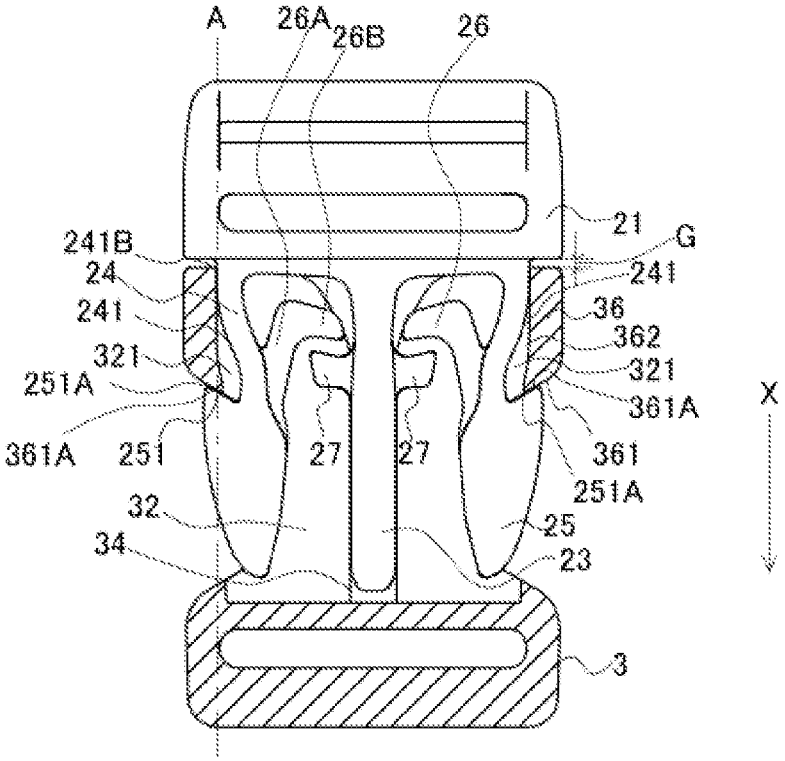
FIG. 4 is a sectional view showing an engaged state of a male member and a female member of the buckle according to an embodiment of the present invention.

FIG. 4 is a partial sectional view showing a state in which the leg 22 of the male member 2 is inserted up to a predetermined position in the cavity 32 of the female member 3 to create an engaged state of the male member 2 and the female member 3 by bringing the engaging face 251A and the engaged face 361A into contact. The side face 241 on the outer side of the base end portion 24 and the cavity 32 surrounded by an inner wall face 362 of the wall portion 36 adjacent to the opening sidewall face 361 of the female member 3, the inner wall face 381 of the lower wall portion of the second sidewall portion 38, and an inner wall face of the upper wall portion (not shown) are each provided with a space permission portion 321. The space permission portion 321 is a gap to permit elastic deformation of the swelling portion 25 of the leg 22 exposed through the opening 33 in a direction opposite to the side on which the legs 22 face each other in a state in which the engaging face 251A and the engaged face 361A are engaged. A moving distance of the swelling portion 25 in the outer direction can be increased by providing the space permission portion 321 and so the swelling portion 25 can be elastically deformed more easily.

Figure 5:
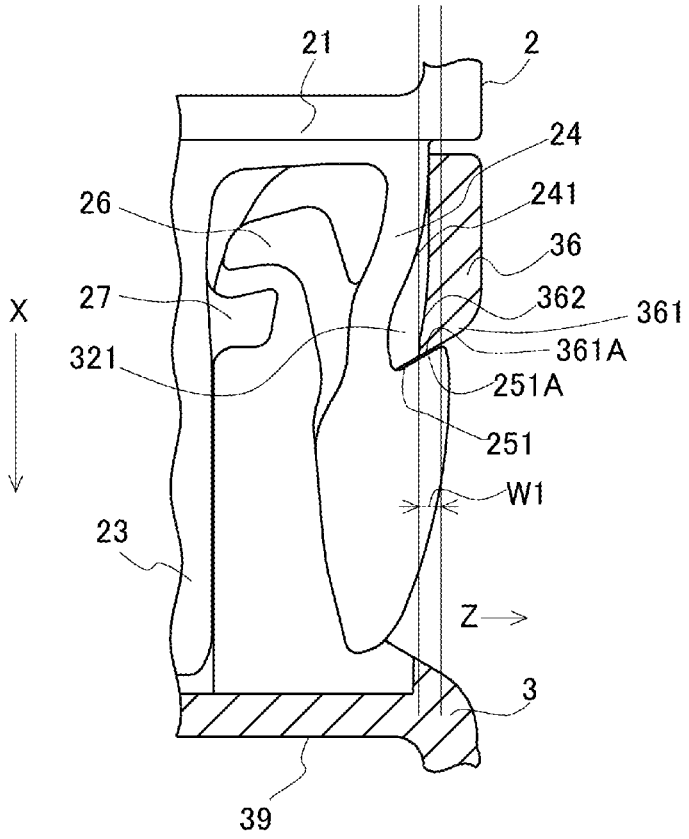
FIG. 5 is a partial sectional view showing the engaged state of the male member and the female member before a tensile external force is exerted in a direction opposite to an insertion direction (X) in the buckle according to an embodiment of the present invention.
Figure 6:
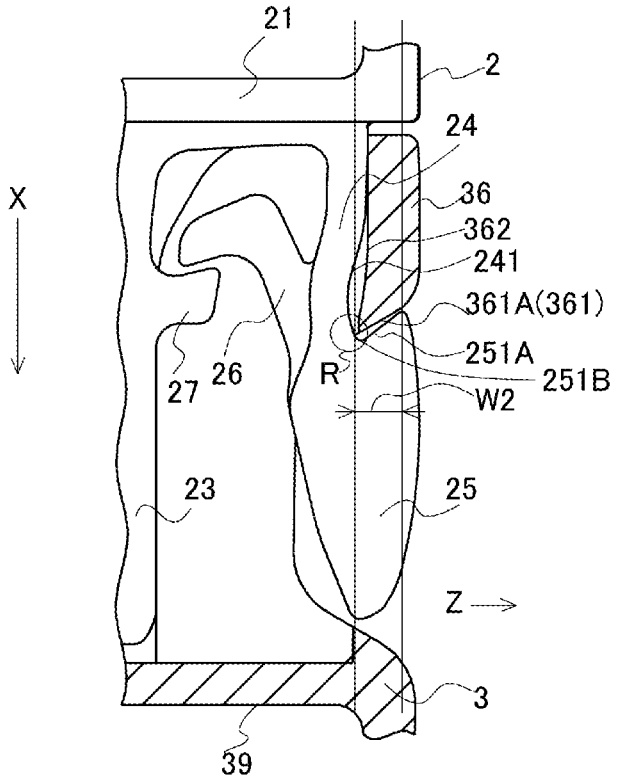
FIG. 6 is a partial sectional view showing the engaged state of the male member and the female member after the tensile external force is exerted in the direction opposite to the insertion direction (X) in the buckle according to an embodiment of the present invention.

As shown, for example, in FIG. 5, the width of opposed portions of the engaging face 251A and the engaged face 361A when an engaged state of the male member 2 and the female member 3 is created by bringing the engaging face 251A and the engaged face 361A closer to each other is defined as an engagement width W1. If an external force in a direction opposite to the insertion direction (X) is further exerted from the state in FIG. 5, the swelling portion 25 of the leg 22 exposed through the opening 33 is elastically deformed in a direction opposite to the side on which the legs 22 face each other along the opening sidewall face 361 and the intersection face 251 by the opening sidewall face 361 and the intersection face 251 being pressed against each other. As a result, as shown in FIG. 6, the opening sidewall face 361 bumps into a region R on the side closer to the intersection face 251 of the side face 241 of the base end portion 24 and approaches an inner end 251B positioned innermost of the intersection face 251. Accordingly, an engagement width W2 of the engaging face 251A and the engaged face 361A becomes larger than the engagement width W1 before pulled in a direction opposite to the insertion direction (X). Therefore, according to the buckle 1 in an embodiment of the present invention, even when an external force in a direction opposite to the insertion direction (X) is exerted, a wide engagement area of the male member 2 and the female member 3 can be secured and so the buckle 1 of high tensile strength can be obtained.

In a conventional buckle, from the viewpoint of characteristics, normally if an external force in a direction opposite to the insertion direction (X) is exerted, like when released, there are frequently cases when the engaged state is automatically disengaged by the fall of the swelling portion 25 of the leg 22 in the inner direction or the swelling portion 25 is damaged because the swelling portion 25 is not deformed.

According to the buckle 1 in an embodiment of the present invention, when an external force in a direction opposite to the insertion direction (X) is exerted, contrary to the conventional buckle, the engagement width W2 (see FIG. 6) after the external force is exerted becomes larger than the engagement width W1 before the external force is exerted after the movement of the swelling portion 25 to the outer side. Accordingly, the engagement area of the engaging face 251A and the engaged face 361A increase, which can improve tensile strength and inhibit the engaged state from unintentionally being disengaged by the movement of the swelling portion 25 to the inner side due to an external force.

Further, according to the buckle 1 in an embodiment of the present invention, as shown in FIG. 4, about a half of the intersection face 251 on the outer side is the engaging face 251A that comes into contact with the opening sidewall face 361 in a state in which the male member 2 is housed inside the female member 3. Similarly, about a half of the opening sidewall face 361 on the inner side is the engaged face 361A that comes into contact with the intersection face 251. That is, compared with a conventional buckle in which almost the entire face of the inclined plane and almost the entire face of the opening sidewall face 361 come into contact, the leg 22 is in a state in which about half the leg is released (half released state) from the start and thus, when the male member 2 is released from the female member 3, the swelling portion 25 needs to be moved to the inner side about half as much as the conventional buckle for release. Therefore, according to the buckle 1 in an embodiment of the present invention, the release load can be reduced when compared with the conventional buckle and so a repulsive force due to an elastic return of the leg 22 can be reduced when the buckle 1 is engaged. As a result, the buckle 1 of soft insertion feeling can be obtained.

If the engagement width W2 after an external force being exerted shown in FIG. 6 becomes too large as compared with the engagement width W1 before an external force being exerted shown in FIG. 5, the release load becomes too small, causing a problem that the engaged state is more likely to be disengaged after the swelling portion 25 is moved to the inner side by an external force. On the other hand, if a difference between the engagement width W2 and the engagement width W1 becomes too small, the amount of movement when the leg 22 is elastically deformed to the inner side for release becomes large, leading to a larger release load. Thus, the engagement width W2 after an external force being exerted is set to 1.5 to 2.5 times the engagement width W1 before an external force being exerted, preferably twice. Though dependent on the type of buckle, the engagement width W1 of the buckle 1 in the state in FIG. 5 can be set to, for example, about 0.9 to 1.3 mm and the engagement width W2 of the buckle 1 in the state in FIG. 6 can be set to, for example, about 1.8 to 2.6 mm.

Further, in the buckle 1 according to the present embodiment, as shown, for example, in FIG. 4, it is preferable to incline the base end portions 24 with respect to the insertion direction (X) so as to gradually come closer to each other in an inner direction from the base end side in contact with the base portion 21 toward the end side continuing to the swelling portion 25. Accordingly, in the vicinity of the engaging face 251A and the engaged face 361A, a larger volume of the space permission portion 321 for the swelling portion 25 to be elastically deformed in the outer direction can be secured; therefore, when an external force in a direction opposite to the insertion direction (X) is exerted on the male member 2 after the engaging face 251A of the male member 2 and the engaged face 361A of the female member 3 are engaged, the swelling portion 25 exposed through the opening 33 is more likely to be elastically deformed in the outer direction, which makes it harder for the male member 2 and the female member 3 to come off.

Further, in the buckle according to the present invention, as shown in FIG. 4, if the straight line parallel to the insertion direction (X) and passing through a connection portion of the base end portion 24 to the base portion 21 is a straight line (A), the engaging face 251A and the engaged face 361A are preferably on the straight line (A). The engagement of the engaging face 251A included in the male member 2 and the engaged face 361A included in the female member 3 is thereby made more reliable and even if an external force is exerted in a direction in which the male member 2 is pulled out of the female member 3 after the insertion, the male member 2 is less likely to come off. Further, on the side face 241 on a side opposite to the side on which the base end portions 24 face each other, the straight line (A) preferably passes through an outer portion 241B of the base end portion 24 positioned farthest from the side facing each other (outermost). Accordingly, the engaging face 251A and the engaged face 361A are arranged on the same straight line parallel to the insertion direction (X), which makes it still harder for the male member 2 to come off the female member 3.

When the male member 2 of the buckle 1 according to an embodiment of the present invention is engaged with the female member 3, the swelling portion 25 of the leg 22 of the male member 2 is moved to the inner side by pinching the swelling portion 25 in the width direction to insert the swelling portion into the cavity 32 from the insertion port 35 of the female member 3. Accordingly, the guide portion 23 is slid in the guide groove 34 shown in FIG. 2. Each of side faces 253 on the outer side of the swelling portion 25 moves in a direction of the mounting portion 39 of the female member 3 while being in contact with the inner wall face 362 of the wall portion 36. Then, when the leg 22 is further inserted, the engaging face 251A included in the leg 22 climbs over the engaged face 361A included in the female member 3 and the leg 22 is restored to its original state, that is, elastically returned in the outer direction by a restoring force for elastic deformation of the leg 22. The elastic return of the leg 22 creates an engaged state by the engaging face 251A and the engaged face 361A being opposed. According to the present invention, when the male member 2 and the female member 3 are engaged, the operation is completed only by elastically deforming the pair of legs 22 in the inner direction and thus, there is no need for other portions to be elastically deformed and the engagement is achieved by a minimum operation force.

Conversely, when the male member 2 of the buckle 1 according to an embodiment of the present invention is released from the female member 3, as shown in FIG. 4, the swelling portion 25 protruding to the outer side from the opening 33 of the female member 3 is pinched in the width direction to move the swelling portion 25 to the inner side. The base end portion 24 is thereby elastically deformed in the inner direction and the side face 253 on the outer side of the swelling portion 25 is moved by sliding on the inner wall face 362 of the wall portion 36 so that the male member 2 finally comes off like flying out of the female member 3. As is evident from FIG. 4, in the buckle 1 according to an embodiment of the present invention, the male member 2 and the female member 3 after being engaged are in contact in about half the area of the opening sidewall face 361 included in the female member 3 and the intersection face 251 included in the male member 2. Thus, compared with a case when the opening sidewall face 361 and the intersection face 251 are brought into full contact, the amount of deformation when the swelling portion 25 is elastically deformed in the inner direction can be reduced so that, compared with a conventional buckle, the load for release can be reduced.

Figure 9:
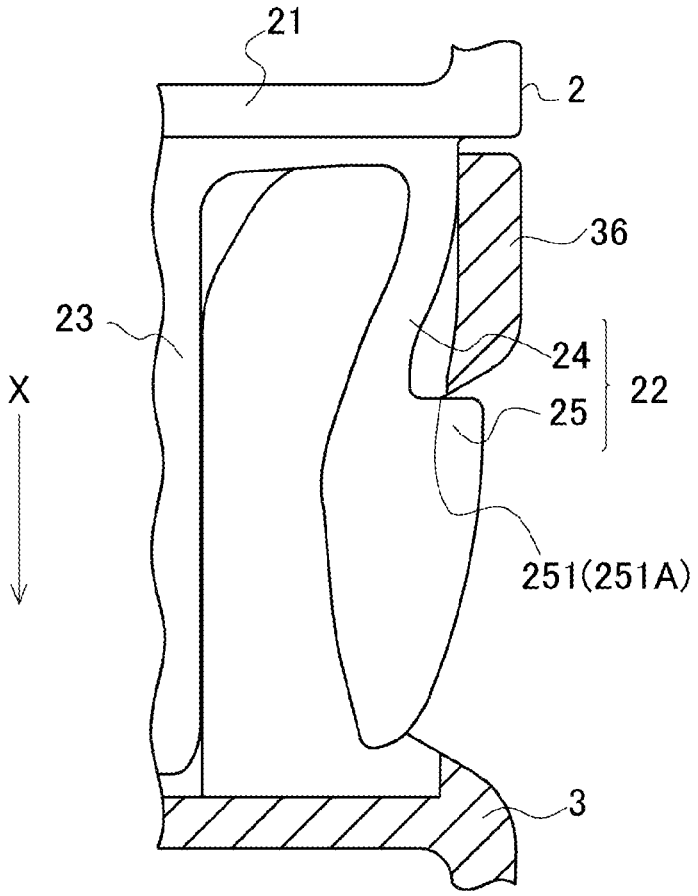
FIG. 9 is a partial sectional view showing a case when the engaging face of the male member is a face perpendicularly intersecting an insertion direction (X) in the buckle according to an embodiment of the present invention.

An embodiment of the present invention has been described above, but the description and drawings constituting a portion of the present disclosure should not be understood as limiting the present invention. In the buckle 1 shown in FIGS. 1 to 8, for example, an example in which the intersection face 251 on which the engaging face 251A is defined is an inclined plane inclined with respect to the insertion direction (X) of the male member 2 is shown. However, the engaging face 251A does not necessarily need to be an inclined plane. That is, as shown in FIG. 9, the intersection face 251 may naturally be a plane intersecting the insertion direction (X) at right angles. Also, as shown in FIG. 9, the buckle 1 according to an embodiment of the present invention may not include the movement regulator 26 or the deformation regulator 27 as shown in FIGS. 1 to 8. As described above, the present invention naturally includes various aspects not described here and can be embodied by making modifications without deviating from the spirits thereof in the stage of working.

REFERENCE SIGNS LIST

1 Buckle
2 Male member
3 Female member
21 Base portion
22 Leg
23 Guide portion
24 Base end portion
25 Swelling portion
26 Movement regulator
27 Deformation regulator
31 Body portion
32 Cavity
33 Opening
34 Guide groove
35 Insertion port
36 Wall portion
39 Mounting portion
211 String mounting hole
212 Coupling rod
231 Outer face
241 Side face
241A Engaging face
241B Outer portion
242 Inner face
251 Intersection face
251A Engaging face
251B Inner end
252 Inner face
253 Side face
321 Space permission portion
361 Opening sidewall face
361A Engaged face
362 Inner wall face
381 Inner wall face

The invention claimed is:

1. A buckle comprising:

a male member; and a female member into which the male member can be inserted for engagement, wherein the male member comprises a base portion on which a cord member can be mounted, a pair of legs extending from one end of the base portion, and a pair of engaging faces each protruding from a side face of one of the legs on an opposite side of a side on which the pair of legs faces each other and defined on a face intersecting an insertion direction of the male member, and wherein the female member comprises a body portion having an insertion port into which the legs can be inserted on one end, a mounting portion on which a cord member can be mounted on the other end, and a cavity communicatively connected to the insertion port to house the legs internally, a pair of openings each passing through a wall portion of the body portion so as to communicatively connect to the cavity, and engaged faces each defined on an opening sidewall face exposed from one of the openings toward the mounting portion and capable of engaging with one of the engaging faces by a restoring force for elastic deformation of the leg when the leg is inserted up to a predetermined position in the cavity, and when an external force in a direction opposite to the insertion direction is exerted on the male member after the engaging faces of the male member and the engaged faces of the female member are engaged, an engagement width between each of the engaging faces and the engaged faces becomes larger than an engagement width before the external force was exerted due to the elastic deformation of the legs exposed through the openings in an opposite direction to the side on which the pair of legs faces each other.

2. The buckle according to claim 1, wherein the engaging face is an inclined plane inclined with respect to the insertion direction of the male member.

3. The buckle according to claim 1, wherein a space permission portion to permit the elastic deformation of one of the legs exposed through one of the openings in the opposite direction in a state in which the engaging face of the one of the legs and the respective engaged face are engaged is provided in the cavity between a side face of the one of the legs and inner wall faces of the female member adjacent to the opening sidewall face.

4. The buckle according to claim 1, wherein each of the legs comprises:

a base end portion extending in the insertion direction from the base portion; and a swelling portion further extending in the insertion direction from the base end portion and also swelling in a leg width direction intersecting the insertion direction, wherein the base end portions are inclined with respect to the insertion direction so as to gradually come closer to each other from a base end side in contact with the base portion toward an end side continuing to the swelling portion.

5. The buckle according to claim 1, wherein each of the legs comprises:

a base end portion extending in the insertion direction from the base portion; and a swelling portion further extending in the insertion direction from the base end portion and also swelling in a leg width direction intersecting the insertion direction, wherein the engaging face is provided in the swelling portion, and wherein for each of the legs the engaging face and the engaged face are on a straight line parallel to the insertion direction and passing through a connection portion of the base end portion to the base portion.

6. The buckle according to claim 5, wherein the straight line passes through an outer portion of the base end portion positioned farthest from the side on which the base end portions face each other on the side face on the opposite side of the side facing each other.

7. The buckle according to claim 1, wherein the male member comprises a guide portion extending in the insertion direction from the base portion between the legs and the female member comprises on the inner wall face a concave guide groove capable of inhibiting movement of the male member in a direction intersecting the insertion direction when the legs of the male member are housed in the cavity.

8. The buckle according to claim 1, wherein the male member further comprises movement regulators provided on each leg and protruding from side faces of the side on which the legs face each other and deformation regulators connected to the base portion by being spaced from the movement regulator and with which the movement regulator comes into contact when the leg is elastically deformed in the opposite direction to regulate further deformation of the leg in the opposite direction.

9. The buckle according to claim 1, wherein the male member comprises a guide portion extending in the insertion direction from the base portion between the legs, the female member comprises on the inner wall face a concave guide groove capable of inhibiting movement of the male member in a direction intersecting the insertion direction when the legs of the male member are housed in the cavity, and after the engaging faces of the male member and the engaged faces of the female member are engaged, an entire inner face of a swelling portion of each of the legs is within the cavity and faces the guide portion.

* * * * *